US006380517B2

(12) United States Patent
Morgan

(10) Patent No.: US 6,380,517 B2
(45) Date of Patent: Apr. 30, 2002

(54) HIGH TEMPERATURE ROTATING VACUUM KILN AND METHOD FOR HEAT TREATING SOLID PARTICULATE MATERIAL UNDER A VACUUM

(75) Inventor: Allan C. Morgan, Manchester, MA (US)

(73) Assignee: Cabot Corporation, Boston, MA (US)

( * ) Notice: Subject to any disclaimer, the term of this patent is extended or adjusted under 35 U.S.C. 154(b) by 0 days.

(21) Appl. No.: 09/747,449

(22) Filed: Dec. 22, 2000

Related U.S. Application Data

(63) Continuation of application No. PCT/US99/13972, filed on Jun. 21, 1999.

(51) Int. Cl.[7] ..... F27B 7/06; F27B 7/08; F27B 7/32; F27B 7/38

(52) U.S. Cl. ..... 219/389; 219/390; 219/388; 432/106; 432/113; 432/117; 34/63; 34/92

(58) Field of Search ..... 219/389, 388, 219/390; 432/117, 103, 106, 113, 115, 118; 34/63, 92; 373/111, 112

(56) References Cited

U.S. PATENT DOCUMENTS

| | | | | |
|---|---|---|---|---|
| 2,507,123 A | | 5/1950 | Sproule et al. | 23/279 |
| 3,039,753 A | | 6/1962 | Eketorp et al. | 263/33 |
| 3,619,908 A | | 11/1971 | Kallas | 34/56 |
| 3,794,462 A | | 2/1974 | Sylvest | 432/80 |
| 3,802,847 A | * | 4/1974 | Hara et al. | 219/389 |
| 3,809,528 A | | 5/1974 | Kramm | 432/80 |
| 3,986,821 A | | 10/1976 | MacNitt, Jr. | 432/112 |
| 4,056,363 A | | 11/1977 | Messner | 23/270 R |
| 4,127,388 A | | 11/1978 | Maczko et al. | 422/258 |
| 4,286,946 A | | 9/1981 | Christini | 432/112 |
| 4,389,794 A | | 6/1983 | Bitterly | 34/5 |
| 4,400,153 A | | 8/1983 | Miskell | 432/103 |
| 4,421,020 A | | 12/1983 | Gross | 99/472 |
| 4,455,135 A | | 6/1984 | Bitterly | 432/1 |
| 4,583,468 A | | 4/1986 | Reed et al. | 110/246 |
| 4,644,664 A | | 2/1987 | Bradshaw | 34/10 |
| 4,914,276 A | | 4/1990 | Blair | 219/390 |
| 4,916,831 A | | 4/1990 | Yasumura et al. | 34/134 |
| 4,973,245 A | | 11/1990 | Monni | 432/77 |
| 4,984,587 A | | 1/1991 | Neville | 131/305 |
| 4,988,289 A | | 1/1991 | Coucher | 432/103 |
| 5,018,968 A | | 5/1991 | Barreto | 432/116 |
| 5,057,009 A | | 10/1991 | Nechvatal et al. | 432/14 |
| 5,100,314 A | | 3/1992 | Rierson | 432/103 |
| 5,169,307 A | | 12/1992 | Frye | 432/14 |
| 5,302,118 A | | 4/1994 | Renegar et al. | 432/14 |
| 5,347,725 A | | 9/1994 | Sato | 34/386 |
| 5,375,344 A | | 12/1994 | Ruefli et al. | 34/269 |
| 5,580,242 A | | 12/1996 | Becker | 432/103 |
| 5,806,204 A | | 9/1998 | Hoffman et al. | 34/92 |
| 6,042,370 A | * | 3/2000 | Weide | 432/103 |

FOREIGN PATENT DOCUMENTS

| | | |
|---|---|---|
| CH | 256598 | 8/1997 |
| DE | 42 02 749 A1 | 5/1993 |
| DE | 42 37 161 A1 | 5/1994 |
| FR | 1353434 | 1/1964 |
| FR | 2584484 | 1/1987 |

* cited by examiner

*Primary Examiner*—Joseph Pelham

(57) ABSTRACT

A rotating vacuum kiln for heat treating solid particulate material under vacuum conditions uses a rotating refractory metal cylindrical vessel with a cool inlet zone, hot intermediate zone, and cool exit zone, with a first series of inner radiation shields provided at the hot intermediate zone adjacent to the cool inlet zone and a second series of inner radiation shields provided at the hot intermediate zone adjacent the cool exit zone to protect those two zones from the high temperatures in the hot intermediate zone. Heat for the hot intermediate zone of the cylindrical vessel is provided indirectly by electrical resistance heaters that surround the vessel and outer radiation shields are provided about the heaters to direct heat to the cylindrical vessel.

22 Claims, 4 Drawing Sheets

HIGH TEMPERATURE ROTATING VACUUM KILN AND METHOD FOR HEAT TREATING SOLID PARTICULATE MATERIAL UNDER A VACUUM

This application is a continuation of prior International Patent Application No. PCT/US99/13972 filed Jun. 21, 1999, which is a continuation of U.S. patent application Ser. No. 09/100,970 filed Jun. 22, 1998 now U.S. Pat. No. 6,105,272.

BACKGROUND OF THE INVENTION

The present invention relates to a rotary vacuum kiln for the treatment of solid particulate material under conditions of high temperature and under a high vacuum.

Solid particulate material must, at times, be treated under a vacuum at high temperatures in order to provide a desired product. In the manufacture of tantalum powders, for example, for use in capacitors, at one or more steps in processing, the powder is heat-treated in a vacuum furnace. Such treatment may be used to drive off residual impurities and to provide a flowable powder. A present processing system involves placement of a stack of trays containing tantalum powder into a vacuum furnace and heating the entire tray assembly. After a comparatively short heat treatment, in such a batchwise treatment, the entire tray assembly is cooled and a small amount of air is admitted until a layer of tantalum oxide has formed on the powder particle surfaces to prevent pyrophoric combustion of the powder upon subsequent exposure to air. Such a treatment is time- and energy-consuming and requires expensive equipment. Also, the fixed bed geometry of the treatment results in material near the outside of the bed being heated sooner and hotter than the material in the middle of the bed or tray stack. Heat transfer is also slow. In addition, since the material on the outside of the bed is heated more than that on the inside, uneven sintering can occur. A non-uniform product can result with various portions of the charge having different physical properties from others. If the material on the inside is not sufficiently sintered, the resultant product is fragile and a large proportion of this material turns to a dust during subsequent handling of the product. Such dust or fines must be recycled for reprocessing.

It is an object of the present invention to provide an apparatus for high temperature treatment of solid particulate material, while under a vacuum, by the use of a rotating kiln that will provide a more uniform heat-treated product.

It is another object of the present invention to provide a method for the continuous high temperature treatment of solid particulate material, such as tantalum powder, while under a vacuum, using a rotating kiln so as to provide a more uniform heat treated product.

SUMMARY OF THE INVENTION

A rotating vacuum kiln has a rotatable refractory metal cylindrical vessel that includes a cool inlet zone, a hot intermediate zone, and a cool exit zone. A gaseous exhaust conduit extends through an end wall of the cylindrical vessel through the cool exit zone and to the hot intermediate zone. A first series of inner radiation shields are provided in the cylindrical vessel at the hot intermediate zone adjacent to the cool inlet zone, and a second series of inner radiation shields are provided at the hot intermediate zone adjacent to the cool exit zone.

A first vacuum housing encloses a feed chute that directs solid particulate material to the cool inlet zone of the cylindrical vessel while under vacuum, while a second vacuum housing encloses a discharge chute for discharging treated material from the cylindrical housing while also under vacuum. Solid particulate material is moved through the rotating refractory metal cylindrical vessel by the use of screw flights attached to the inner surface of the vessel wall or by tilting the cylindrical vessel to allow flow by gravity.

The hot intermediate zone of the cylindrical vessel is indirectly heated by electric resistance heating bands which are provided, spaced from and along the hot intermediate zone, while outer radiation shields surround the heating bands and the cylindrical vessel along the hot intermediate zone. The use of the heating bands, radiation shields, and first and second series of inner radiation shields, concentrate the heat in the hot intermediate zone of the cylindrical vessel and shield the cool inlet zone, cool exit zone, and associated mechanical equipment, such as drive equipment and support equipment, from the high temperatures of the hot intermediate zone.

A method of heating a solid particulate material to high temperatures includes providing a rotating refractory metal cylindrical vessel having a cool inlet zone, hot intermediate zone and cool exit zone, with a first series of inner radiation shields at the hot intermediate zone adjacent the cool inlet zone and a second series of inner radiation shields at the hot intermediate zone adjacent the cool exit zone. Solid particulate material is moved through the rotating refractory metal cylindrical vessel while under a vacuum from the cool inlet zone and heated to a temperature of between about 1000° to 1700° C. in the hot intermediate zone and then discharged from the cool exit zone of the rotating refractory metal cylindrical vessel.

BRIEF DESCRIPTION OF THE DRAWINGS

The present invention will be more readily understood by reference to the following description of embodiments thereof and the accompanying drawings, wherein.

DETAILED DESCRIPTION OF THE PRESENT INVENTION

The rotating vacuum kiln of the present invention enables the heating of solid particulate material to a high temperature, for heat treatment or sintering under high vacuum conditions.

Figure 1:
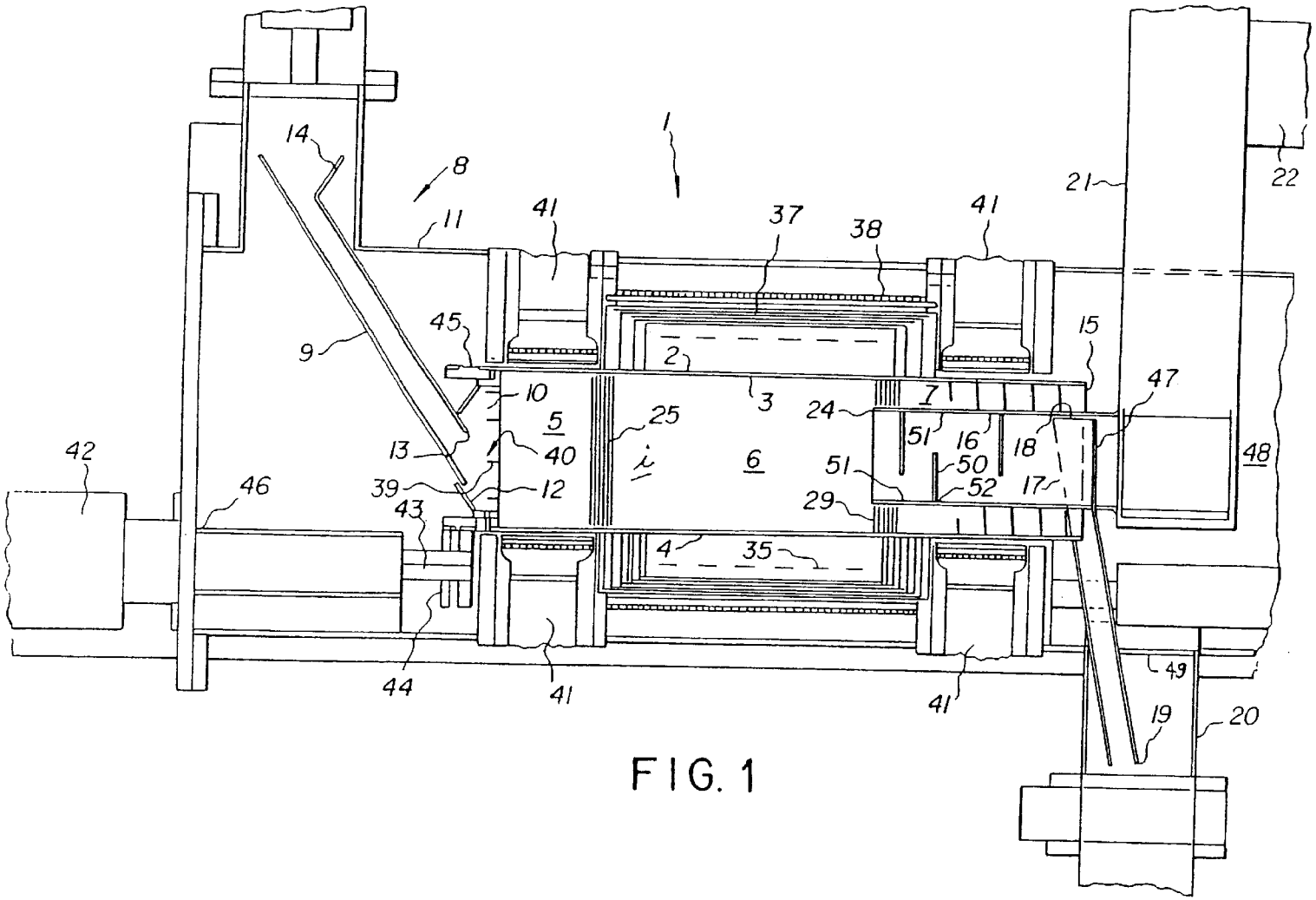
FIG. 1 is a longitudinal sectional view of a rotating refractory metal cylindrical vessel of the rotating vacuum kiln of the present invention.

Referring now to the drawings, FIG. 1 illustrates an embodiment of a rotary vacuum kiln 1 of the present invention having a rotating refractory metal cylindrical vessel 2 having an inner wall 3 and an outer wall 4, the rotating refractory metal cylindrical vessel 2 having a cool inlet zone 5, a hot intermediate zone 6, and a cool exit zone 7. A means 8 for charging a solid particulate material is provided on the cool inlet zone 5 of the cylindrical vessel 2, such as a feed chute 9, which feeds the material to a mixing and charging conduit 10 attached to the cylindrical vessel 2, that communicates with the cool inlet zone 5, the feed chute 9 and mixing and charging conduit 10 enclosed in a first vacuum housing 11. The mixing and charging conduit 10 includes an inclined wall 12 on the cylindrical vessel 2 that acts as a dam to prevent solid particulate material from escaping from the mixing and charging conduit 10 rather than moving towards the cool inlet zone 5 of the cylindrical vessel 2, which inclined wall 12 receives and encloses the discharge end 13 of the feed chute 9. Feed chute 9 also has an outwardly flared section 14 at the upper end to receive solid particulate material. The cool exit zone 7 of the cylindrical vessel 2 has an end wall 15 with a gaseous exhaust conduit 16 passing through the wall 15, and a discharge chute 17 communicating with the cylindrical vessel 2 at the cool exit zone 7, the discharge chute 17 having an open receiving end 18 within the cool exit zone 7 for receiving solid particulate material therefrom and a discharge end 19 for discharging solid particulate material therefrom. The discharge end 19 of discharge chute 17 is enclosed in a second vacuum housing 20.

Extending through the end wall 15 of the cylindrical vessel 2, the gaseous exhaust conduit 16 receives gases from the cylindrical vessel 2 and passes the same to a gaseous discharge conduit 21, while gaseous discharge conduit 21 is connected to a vacuum line 22 that is, in turn, connected to a vacuum pump 23. The gaseous exhaust conduit 16 is preferably concentric with an axis a of the cylindrical vessel 2, extends through the cool exit zone 7, and has an open end 24 disposed in the intermediate hot zone 6 of the cylindrical vessel 2.

Figure 2:
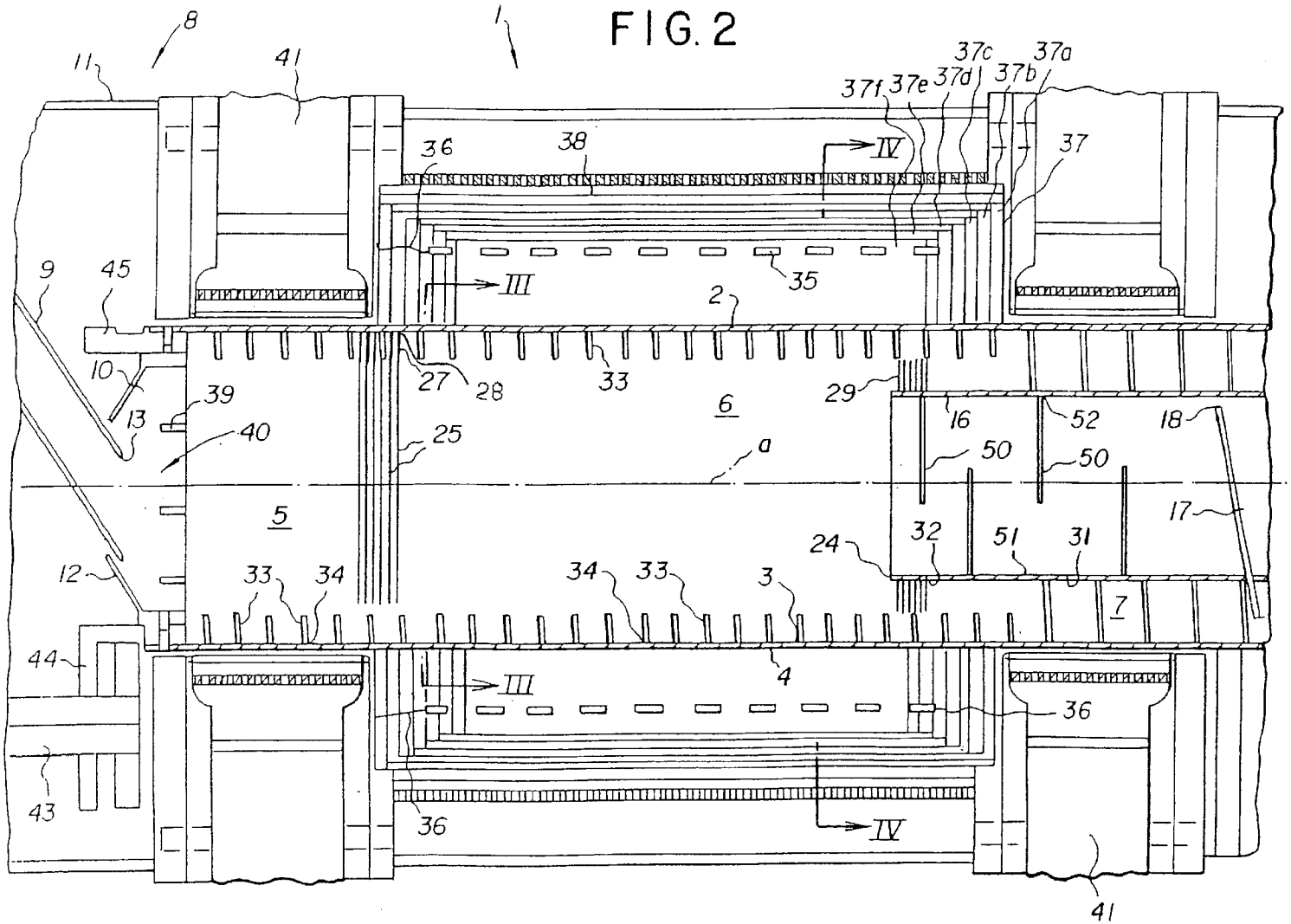
FIG. 2 is a longitudinal sectional view through another embodiment of a rotating vacuum kiln of the present invention.
Figure 4:
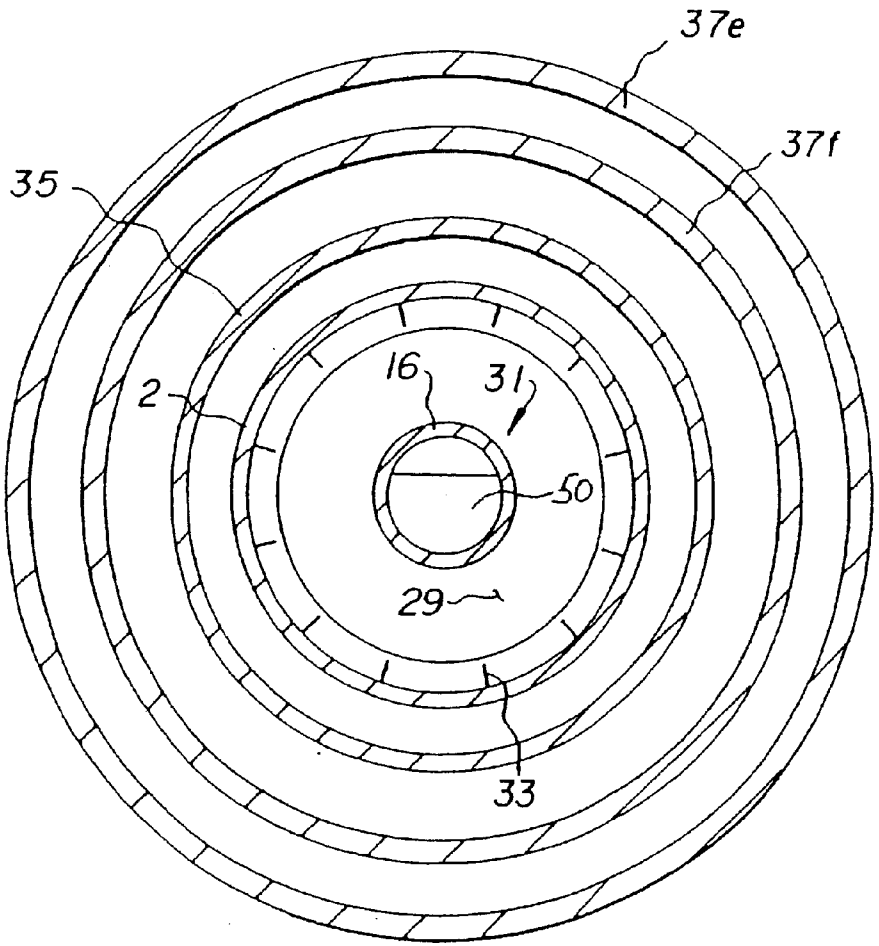
FIG. 4 is a view taken along lines IV—IV of FIG. 2.
Figure 3:
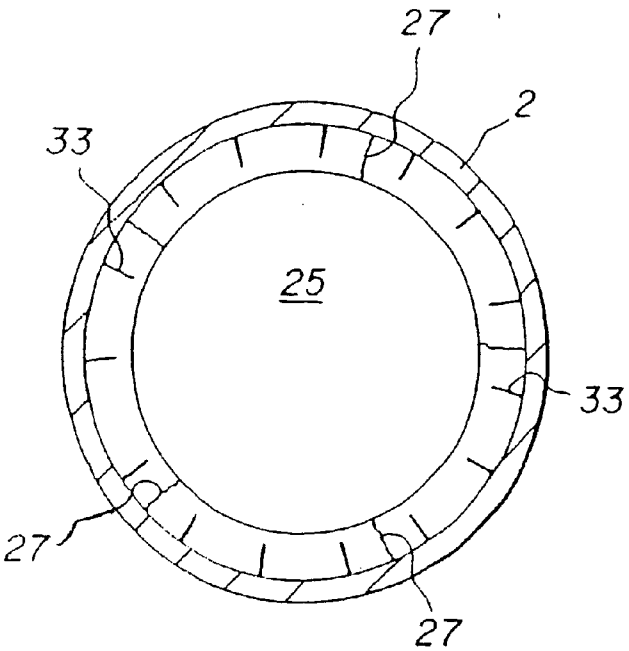
FIG. 3 is a view taken along lines III—III of FIG. 2.

A first series of inner radiation shields 25 is provided at the hot intermediate zone 6 adjacent to the cool inlet zone 5 of the cylindrical vessel 2 so as to reduce the flow of heat from the intermediate hot zone 6 to the cool inlet zone 5 of the cylindrical vessel 2. The first series of inner radiation shields 25 are secured to the inner wall 3, such as by spokes 27 (FIG. 2) that extend towards the inner wall and are welded, such as at 28 to the inner wall 3.

A second series of inner radiation shields 29 is provided in the hot intermediate zone 6 adjacent to the cool exit zone 7 of the cylindrical vessel 2 so as to reduce the flow of heat from the intermediate zone 6 to the cool exit zone 7. The second series of inner radiation shields 29 are secured to the outer wall 31 of the gaseous exhaust conduit 16, such as by welds 32. The second series of inner radiation shields 29 shields the cool exit zone 7 from the high temperatures of the intermediate hot zone 6 of the cylindrical vessel 2. A series of short screw flights 33 may be provided in the cool inlet zone 5, intermediate hot zone 6, and cool exit zone 7, secured to the inner wall 3 such as by welds 34, to move solid particulate material through the rotating refractory metal cylindrical vessel.

The intermediate hot zone 6 of the cylindrical vessel 2 is heated by use of an indirect heat source, such as electrical resistance heating bands 35 which are spaced from and encircle the outer wall 4 of the cylindrical vessel 2. The heating bands 35 extend along the length of the intermediate hot zone 6 and are energized through an electric current fed from a source (not shown) through electrical leads 36. In order to concentrate and direct the heat from the electrical resistance heating bands 35 towards the outer wall 4 of cylindrical vessel 2, at least one radiation shield 37 and preferably a series of radiation shields 37*a* to 37*f*, are provided which are positioned concentrically about and spaced from the electrical resistance heating bands 35 and the intermediate hot zone 6 of the cylindrical vessel 2 and encircle and enclose the same. The radiation shields 37*a*–37*f* are enclosed within a shield housing 38.

The cool inlet zone 5 of the cylindrical vessel 2 may be provided with the series of short cool inlet zone screw flights 33 which are secured to the inner wall 3, such as by welds 34, and which extend from the inner wall 3 and will serve to move solid particulate material from the mixing and charging conduit 10 to the intermediate hot zone while a plurality of inwardly directed mixing flanges 39 may be provided on the inner wall 40 of the mixing and charging conduit 10 to mix solid particulate material fed thereto and charge the same to the short cool inlet zone screw flights 33.

Because the intermediate hot zone 6 of the cylindrical vessel 2, heating bands 35 and radiation shields 37 are contained in shield housing 38 and the first series of inner radiation shields 25 and second series of inner radiation shields 29 retain the heat within the intermediate hot zone, water cooled spool sections 41 may be used to enclose outer wall 4 of the cool inlet zone 5 and cool exit zone 7, and the spool sections may be made of less expensive ferrous alloy rather than a refractory metal as is required for the cylindrical vessel 2. The cylindrical vessel 2 may be rotated such as by use of a motor 42, having a shaft 43 with gears 44 that engage with a ring gear 45 carried by the cylindrical vessel 2, with the gears 44 contained within first vacuum housing 11 and shaft 43 passing through a seal 46 secured in a wall of the housing 11.

The end wall 15 of the cylindrical vessel 2 and the outer end 47 of the gaseous exhaust conduit 16 are also enclosed in a third vacuum housing 48, with discharge chute 19 passing through the lower wall 49 of third vacuum housing 48 into the second vacuum housing 20. The gaseous exhaust conduit 16 preferably has a plurality of baffles 50 connected to the inner wall 51, such as by welds 52 which are offset and spaced from each other along the horizontal axis a so as to provide a tortuous path for gases flowing therethrough.

Figure 5:
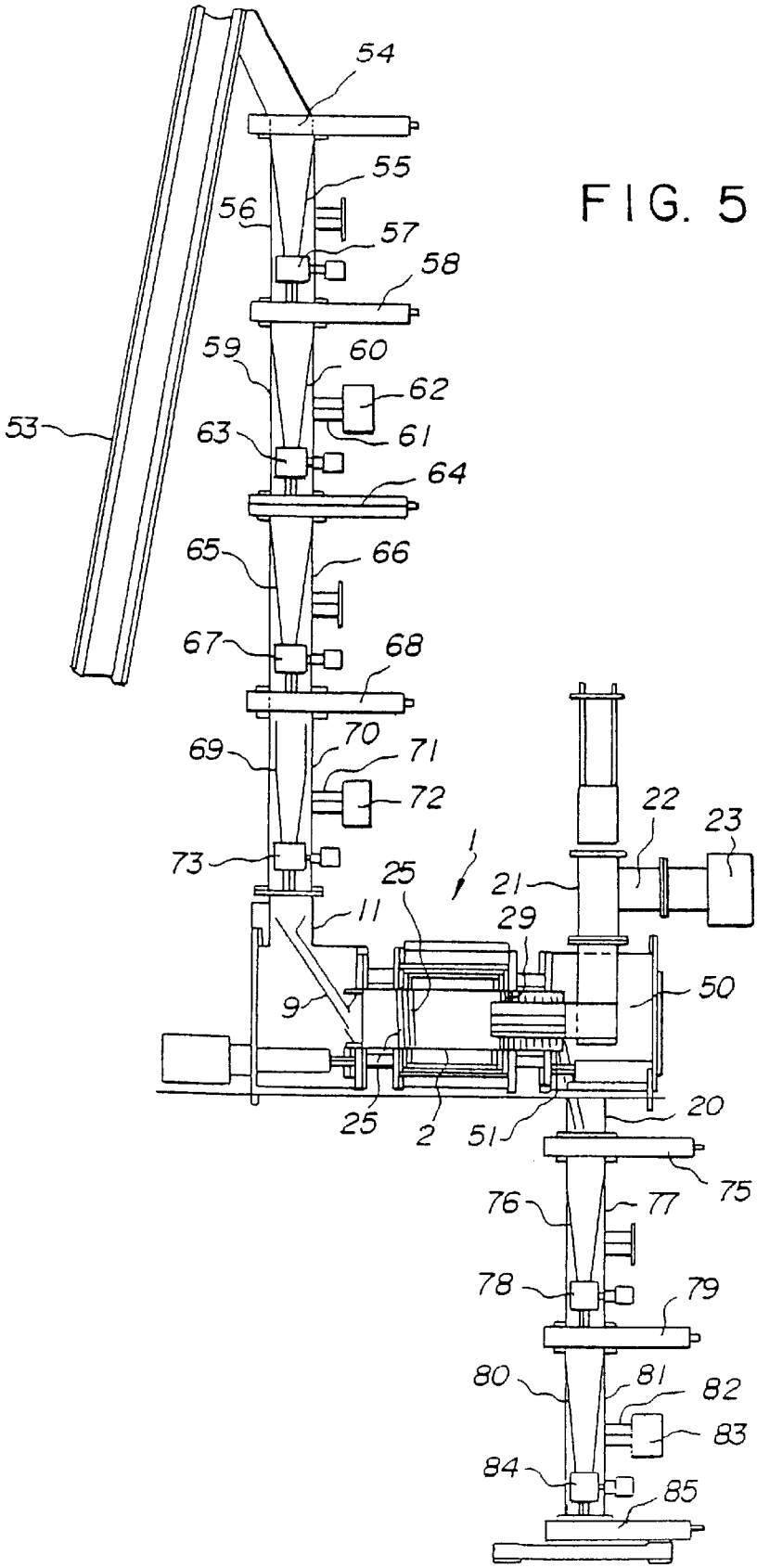
FIG. 5 is a schematic view of the rotating vacuum kiln of FIG. 1 illustrating the systems for feeding and discharging material under vacuum.

In order to maintain the interior i of the cylindrical vessel 2 under vacuum, while treating solid particulate material therein, the source of vacuum, vacuum pump 23, pulls a vacuum through vacuum line 22, gaseous discharge conduit 21, gaseous exhaust conduit 16, the interior i of cylindrical vessel 2, second vacuum housing 20, and first vacuum housing 11, with seals and bearings provided where necessary to keep leakage within acceptable limits, as is known to one skilled in the art. To assist in maintaining the vacuum within the system, and particularly within the interior i of the cylindrical vessel 2, a series of sealable feed hoppers and sealable discharge hoppers are provided, as shown in FIG. 5. As schematically illustrated, for charging the cylindrical vessel 2, solid particulate material to be treated is fed through a feed line 53, through a sealable inlet valve 54, to an initial feed chute 55, contained within a first feed housing 56 having a feeder 57 which cooperates with a second sealable valve 58. Second sealable valve 58 feeds to a second feed chute 59 which is contained within a first roughing vacuum feed housing 60 that is connected through line 61 to a source of vacuum, such as pump 62, and which has a feeder 63 which cooperates with a third sealable valve 64. Third sealable valve 64 feeds to an intermediate transfer feed chute 65 contained in an intermediate feed housing 66 that has an intermediate feeder 67 which cooperates with a fourth sealable valve 68. Fourth sealable valve 68 feeds to a further feed chute 69 which is contained within a housing 70 that is connected through line 71 to a source of vacuum, such as pump 72, and which has a feeder 73 which cooperates with a sealable valve 74 which cooperates with the first vacuum housing 11 so as to feed solid particulate material therefrom through outwardly flared section 14 to feed chute 9 and then to the cool inlet zone 5 of the cylindrical vessel 2. For discharging treated solid particulate material from the cylindrical vessel 2, the treated material is fed by the rotating refractory metal cylindrical vessel 2 into the open end 18 of discharge chute 17 into second vacuum housing 20, and through a first sealable discharge valve 75 into intermediate discharge chute 76 contained in a housing 77 that has an intermediate discharge feeder 78 which cooperates with a second sealable discharge valve 79. Second sealable discharge valve 79 feeds to a second discharge chute 80 which is contained in roughing discharge housing 81 that has a discharge line 82 for reducing the vacuum in the roughing discharge housing 81 through reduction valve 83, and which has a discharge feeder 84 which cooperates with final discharge sealable valve 85 to discharge the material from the system.

The operation of the rotating vacuum kiln 1 of the present invention is as follows. With motor 42 activated, the cylindrical vessel 2 is rotated by means of gears 44 meshing with gear ring 45 and upon activation of the vacuum pump 23, the system including vacuum line 22, gaseous discharge conduit 21, interior of housing 48, gaseous exhaust conduit 16, discharge chute 17, interior of second discharge housing 20, the interior i of cylindrical vessel 2, mixing and charging conduit 10, and the interior of first vacuum housing 11 are placed under a vacuum as is desired for a particular treatment. The electrical resistance heating bands 35 are activated to heat the hot intermediate zone 6 of the cylindrical vessel 2 to the desired temperature, with radiation shields 37 retaining such heating. At this stage, solid particulate material to be treated is provided in further feed chute 69, with the interior of housing 70, with sealable valves 68 and 74 closed, subjected to a vacuum comparable to that within the cylindrical vessel 2, by means of vacuum pump 72. Upon opening of sealable valve 74, solid particulate material is fed by feeder 73 to the feed chute 9 through outwardly flared section 14 and passes by gravity through the feed chute 9 to the mixing and charging conduit 10. In mixing and charging conduit 10, which is connected to, and rotating with, the cylindrical vessel 2, the solid particulate matter is mixed, by contact with and tumbling by flanges 39 on inner wall 40, while the inclined wall 12 prevents material escaping and urges the material into the cool inlet zone 5 of the cylindrical vessel 2. The solid particulate material in cool inlet zone 5 is moved by the short cool inlet zone screw flights 33 to, and through, the hot intermediate zone 6, while heating the material to the desired temperature. The hot material is then transferred, by short intermediate hot zone screw flights 33, towards the open receiving end 18 of discharge chute 17, with the hot material then fed through discharge chute 17 to housing 20 for discharge from the system. During the operation of the rotating vacuum kiln 1, the first series of inner radiation shields 25 shields the cool inlet zone 5 from the high temperature of the hot intermediate zone 6, while the second series of inner radiation shields 29 shields the cool exit zone 7 from that high temperature.

The present invention uses the above described rotating refractory metal cylindrical vessel 2 in heat-treating of solid particulate material. Solid particulate material is charged, under vacuum, to the cool inlet zone 5 of the rotating refractory metal cylindrical vessel 2, which has a cool inlet zone 5, hot intermediate zone 6 and cool exit zone 7, and a first series of inner radiation shields 25 at the hot intermediate zone 6 adjacent to the cool inlet zone 5, and a second series of inner radiation shields 29 at the hot intermediate zone 6 adjacent to the cool exit zone 7. The solid particulate material is moved through the rotating refractory metal cylindrical vessel 2 while under a vacuum and heated in the hot intermediate zone 6 to a temperature of between about 1000° to 1700° C. in the hot intermediate zone 6 and then discharged from the cool exit zone 7.

The heat treatment of solid particulate material according to the present invention is carried out under vacuum conditions and can be carried out at a vacuum below about 0.001 Torr and as low as about $10^{-4}$ Torr or lower, with residence times in the hot intermediate zone 6 from about 0.3 to about 2.0 hours. With the use of the first and second series of radiation shields 25 and 29, with temperatures of between about 1000°–1700° C., preferably 1400°–1600° C. in the hot intermediate zone 6, the temperatures in the cool inlet zone 5 and the cool exit zone 7 would be about 300° C. or below.

When heat-treating of tantalum powder, for example, temperatures in the 1500° C. range would be required in the hot intermediate zone 6 and the rotating refractory metal cylindrical vessel 2 would be composed of a refractory metal, such as molybdenum, tantalum, tungsten, or a refractory metal alloy such as a molybdenum alloy containing minor amounts of titanium and zirconium. The term refractory metal, as used herein, is used to designate a metal which will last for sufficient periods of time at temperatures in the range of up to about 1700° C. without deleterious effects. Where tantalum is to be treated, for example, the cylindrical vessel 2 could be formed from a molybdenum alloy containing minor amounts of titanium and zirconium, with an inner liner of tantalum which would contact the hot solid particulate material being treated through the cylindrical vessel 2, and with tantalum screw flights 33 welded to the inner liner on the wall 3 of the cylindrical vessel 2 and stitch-welded to each other so as to avoid differential expansion problems. A preferred embodiment would be "TEM", which is an alloy of molybdenum with about 0.5% by weight titanium and 0.08% by weight zirconium. A preferred liner material is tantalum when processing tantalum powder.

Other powders can also be processed in the rotating vacuum kiln according to the present invention. For example, other valve metal powders can be processed in a manner similar to that used in processing tantalum powder. Niobium powders can also be processed in the rotating vacuum kiln according to the process of the present invention, in a manner similar to that used for processing tantalum powder.

According to the present invention, additives or dopants may be added to a particulate material before, during, and/or after treatment of the material in the rotating vacuum kiln of the present invention. Preferably, dopants used for controlling sintering and/or agglomeration of the particulate material are blended or mixed with the material before introduction into the rotating vacuum kiln. One or more dopants may instead be added directly into the rotating kiln separate from the introduction of the particulate material to the kiln. If added directly to the kiln, the feeding device for the dopant preferably operates under the same high vacuum conditions which exist within the rotating kiln. Dopants added directly to the kiln may be fed by a gravity feed system, for example.

Dopants which may be employed to control the sintering and/or agglomeration of particulate material treated with the rotating vacuum kiln include phosphorous, nitrogen, carbon, silicon, boron, and sulfur, and the like. These dopants, and the introduction of these dopants into particulate material, are described in U.S. Pat. No. 5,448,447 to Chang, which is herein incorporated in its entirety by reference. Phosphorous is a preferred dopant for tantalum, niobium, and other valve metal powders which are to be sintered and agglomerated in the rotating vacuum kiln of the present invention. The dopant may be supplied in any of a variety of forms, with liquid forms being preferred according to some embodiments of the present invention. If phosphorous is used as the dopant, it is preferably supplied as phosphoric acid or in the powdered form $NH_4PF_6$.

The amount of dopant to be added to the particulate material before or during sintering is preferably enough to control sintering and agglomeration of the particulate material and provide a flowable particulate material without deleteriously interfering with the performance of a capacitor made from the resulting treated material. For example, phosphorous dopants are preferably employed in an amount to achieve a final phosphorous content in the treated material of from about 50 or less to about 200 parts per million (ppm) or more by weight elemental phosphorous based on the total weight of the treated material. Other ranges of phosphorous and nitrogen dopants are described in U.S. Pat. No. 5,448,447.

If nitrogen is used as a dopant, the dopant may be added before, during, and/or after treatment of the particulate material in the rotating vacuum kiln of the present invention. If provided in the form of nitrogen gas, the gas is preferably introduced in a counter-current flow relative to the flow of particulate material through the rotating vacuum kiln. Preferably, no gaseous dopant is introduced into the rotating vacuum kiln during sintering so that the high vacuum conditions within the kiln are preserved. Nitrogen doping can occur simultaneously with oxygen passivation after sintering of a particulate material.

The residence time of a particulate material to be treated in the cylindrical vessel 2 can be adjusted as desired by the pitch, height and cylindrical vessel rotation speed. In some instances, as shown in FIG. 1, the use of screw flights 33 may be avoided if the cylindrical vessel 2 is positioned at a downward angle from the cool inlet zone 5 to the cool exit zone 7 and the material allowed to assume its natural angle of rill under rotation, and the material will move the same through the cylindrical vessel 2.

Feeding of the cylindrical vessel 2 is carried out by feeding solid particulate material through feed line 53 and through open valve 54 into initial feed hopper or chute 55 at atmospheric pressure. Valve 54 is then closed and the material transferred by feeder 57 through opened valve 58 into second feed chute 59. With valve 58 and valve 64 in closed position, a partial vacuum is provided in housing 60 through line 61 by activation of vacuum pump 62. When the desired partial vacuum is achieved, valve 64 is opened and feeder 63 feeds the material to intermediate transfer feed chute 65. Valve 64 is then closed and valve 68 opened, and the material, under partial vacuum, is fed by intermediate feeder 67 into further feed chute 69. With valves and with vacuum pump 72 activated, a vacuum that approaches the high vacuum desired in the cylindrical vessel 2 is applied and feeder 73 is used to discharge the material to feed chute 9 through flared section 14. In the heat treating of tantalum powder, a vacuum in the refractory metal cylindrical vessel 2 of about 0.001 Torr or below would be provided. In discharge of treated material from the cylindrical vessel 2, a reverse procedure is carried out, where treated solids from the cylindrical vessel 2 are discharged therefrom through the discharge chute 76 into second vacuum housing 20. With second discharge valve 79 closed, the first discharge valve 75 is opened and the material fed to intermediate discharge chute 76. First discharge valve 75 is then closed and second discharge valve 79 opened as that material is fed by intermediate discharge feeder 78 into second discharge chute 80. With final discharge valve 85 in closed position, second discharge valve 79 is then closed and vacuum released through line 82 and reduction valve 83. The material may be discharged into a further rotating drum (not shown) at atmospheric pressure where cooling and passivation would be effected. With the vacuum released, and a small amount of air injected to form an oxidized coating on the material, the final discharge valve 85 may then be opened and the treated material removed for use.

What is claimed is:

1. A rotating vacuum kiln comprising:

a rotating refractory metal cylindrical vessel having inner and outer walls, a cool inlet zone, a hot intermediate zone and a cool exit zone;

means for charging solid particulate material for heating into said cool inlet zone while under a vacuum;

a supply of additive or dopant and means for adding said supply of additive or dopant to solid particulate material in said rotating refractory metal cylindrical vessel;

means for discharging said solid material after heating from said cool exit zone while under a vacuum;

means for moving the solid particulate in a direction from the charging means to the discharge means;

a first series of inner radiation shields in the cylindrical vessel at said hot intermediate zone, adjacent to said cool inlet zone, and a second series of inner radiation shields at said hot intermediate zone adjacent to said cool discharge zone;

a gaseous exhaust conduit extending into said cool exit zone and at least partially into said hot intermediate zone for removing gases and vaporized material therefrom;

means for indirectly heating said hot intermediate zone; and radiation shields surrounding the refractory metal cylindrical vessel along said hot intermediate zone.

2. The rotating vacuum kiln as defined in claim 1, wherein said first series of inner radiation shields are connected to the inner wall of said refractory metal cylindrical vessel.

3. The rotating vacuum kiln as defined in claim 1, wherein said second series of inner radiation shields are connected to an outer surface of said gaseous exhaust conduit.

4. The rotating vacuum kiln as defined in claim 1, wherein said means for moving the particulate material in a direction from the charging means to the discharge means comprises a series of screw flights attached to the inner wall of the cylindrical vessel.

5. The rotating vacuum kiln as defined in claim 1, wherein said gaseous exhaust conduit extends into said hot intermediate zone and said second series of screw flights extend from the inner wall of said cylindrical vessel to a location closely adjacent to an outer wall of said gaseous exhaust conduit.

6. The rotating vacuum kiln as defined in claim 1, wherein said means for heating said hot intermediate zone comprises electric resistance heaters spaced from and about the outer wall of said cylindrical vessel.

7. The rotating vacuum kiln as defined in claim 6, wherein said radiation shields are a plurality of radiation shields which are spaced from each other and spaced from and surround and enclose said electric resistance heaters.

8. The rotating vacuum kiln as defined in claim 1, wherein the interior of said cylindrical vessel is maintained under a vacuum by a vacuum pump which cooperates through a housing with said gaseous exhaust conduit.

9. A rotating vacuum kiln as defined in claim 1, including a first housing which encloses a charging conduit attached to said cylindrical vessel and which feeds solid particulate material into the cool inlet zone of said cylindrical vessel.

10. A rotating vacuum kiln as defined in claim 9, including an inclined wall on said charging conduit at said inlet zone which surrounds the discharge end of a feed chute, and a plurality of inwardly directed mixing flanges on the inner wall of said charging conduit between said inclined wall and said cool inlet zone.

11. A rotating vacuum kiln as defined in claim 1, wherein said means for discharging said solid material, after heating, from said cool exit zone includes a discharge chute having an open receiving end in said cool exit zone and a discharge end which discharges said solid material into a discharge housing.

12. A rotating vacuum kiln as defined in claim 1, including a plurality of sealable and interconnected feed hoppers to which solid particulate material to be treated is fed and through which said solid particulate material passes while being subjected to an increased vacuum before being charged to a feed chute for said cylindrical vessel.

13. A rotating vacuum kiln as defined in claim 1, including a plurality of sealable and interconnected discharge hoppers through which material discharged from said cylindrical vessel passes while being subjected to a reduction in vacuum before discharge therefrom.

14. A rotating vacuum kiln as defined in claim 1, wherein said refractory metal of the cylindrical vessel is a molybdenum alloy containing minor amounts of titanium and zirconium.

15. A rotating vacuum kiln as defined in claim 14, wherein a tantalum inner liner is provided on the inner wall of said cylindrical vessel, and screw flights composed of tantalum are welded to said tantalum liner.

16. A rotating vacuum kiln comprising:

a rotating refractory metal cylindrical vessel having inner and outer walls, a cool inlet zone, a hot intermediate zone and a cool exit zone;

means for charging solid particulate material for heating into said cool inlet zone while under a vacuum;

a supply of additive or dopant and means for adding said supply of additive or dopant to solid particulate material in said rotating refractory metal cylindrical vessel;

means for discharging said solid material after heating from said cool exit zone while under a vacuum;

a first series of inner radiation shields attached to the inner wall of the cylindrical vessel, at said hot intermediate zone, adjacent to said cool inlet zone;

a second series of inner radiation shields positioned in the cylindrical vessel at said hot intermediate zone, adjacent to said cool exit zone;

series of screw flights attached to the inner wall of the cylindrical vessel adapted to move solid particulate material in a direction from the charging means to said discharging means;

a gaseous exhaust conduit extending into said cool exit zone and at least partially into said hot intermediate zone for removing gases and vaporized material therefrom;

electrical resistance heaters spaced from and about the outer wall of said cylindrical vessel along the hot intermediate zone; and a plurality of outer radiation shields which are spaced from each other and spaced from, surround and radially enclose said electrical resistance heaters.

17. A method of heating a solid particulate material to a temperature of 1000° to 1700° C. under a vacuum comprising:

producing a rotating refractory metal cylindrical vessel having inner and outer walls, a cool inlet zone, a hot intermediate zone, and a cool exit zone, a first series of inner radiation shields at said hot intermediate zone adjacent said cool inlet zone and a second series of inner radiation shields at said hot intermediate zone adjacent said cool exit zone, moving solid particulate material through said rotating refractory metal cylindrical vessel while under a vacuum;

adding a supply of additive or dopant to said solid particulate material;

heating said solid particulate material to a temperature of 1000° to 1700° C. in said hot intermediate zone; and discharging said heated solid particulate material from said cool exit zone.

18. The method as defined in claim 17, wherein said vacuum is at 0.001 Torr or below.

19. The method as defined in claim 17, wherein said solid particulate material is tantalum powder.

20. The method as defined in claim 19, wherein said vacuum is at 0.001 Torr or below.

21. The method as defined in claim 19, wherein the residence time of said tantalum powder in the hot intermediate zone is between about 0.3 to 2.0 hours.

22. The method as defined in claim 19, wherein said temperature is from about 1400° to about 1600° C.

* * * * *